United States Patent [19]

Chen

[11] Patent Number: 4,685,577

[45] Date of Patent: Aug. 11, 1987

[54] NURSING BOTTLE

[76] Inventor: Wen Chung Chen, No. 18, Lane 31, Wen Ming Road, Tun Tong T'sun, Hou Li Hsiang, Taichung, Taiwan

[21] Appl. No.: 855,397

[22] Filed: Apr. 24, 1986

[51] Int. Cl.[4] ..... A61J 9/04; A61J 11/04

[52] U.S. Cl. ..... 215/11 D; 215/11 R; 215/11 B

[58] Field of Search ..... 215/11 R, 11 A–11 E

[56] References Cited

U.S. PATENT DOCUMENTS

| | | | |
|---|---|---|---|
| 362,554 | 5/1887 | Suydam | 215/11 B |
| 1,794,728 | 3/1931 | Oliver | 215/11 R |
| 2,394,722 | 2/1946 | Sloane | 215/11 B |
| 2,812,092 | 11/1957 | Witz | 215/11 R |
| 3,134,495 | 5/1964 | Carbonel | 215/11 B |
| 3,200,980 | 8/1965 | Jamell | 215/11 B |
| 3,722,728 | 3/1973 | Yazaki | 215/11 B |
| 4,545,491 | 10/1985 | Bisgaard et al. | 215/11 B X |

FOREIGN PATENT DOCUMENTS

| | | | |
|---|---|---|---|
| 27946 | 9/1910 | United Kingdom | 215/11 B |
| 388839 | 3/1933 | United Kingdom | 215/11 B |
| 529438 | 11/1940 | United Kingdom | 215/11 R |

*Primary Examiner*—William Price
*Assistant Examiner*—Sue A. Weaver
*Attorney, Agent, or Firm*—Cushman, Darby & Cushman

[57] ABSTRACT

An improved nursing bottle has two opened ends, equipped with an air-penetrating board, a discharge regulating element in funnel shape, and a pair of lower and upper caps. The air-penetrating board, secured to the bottom of the bottle by a removably attached cap, is fabricated with a number of air-inlet apertures thereon, which permit air to flow in therethrough as long as the nipple is sucked by the infant using the bottle, producing an unbalanced air pressure therein so as to get the closed aperture open for allowing air to flow in so to make the fluid discharge in a more steady manner. Also, air bubbles, which often cause infants using nursing bottles to cough, can not form therein, and the problem of swallowing a lot of air in feeding by the infant can also be prevented. Furthermore, this kind of bottle can be cleaned with much ease.

1 Claim, 5 Drawing Figures

NURSING BOTTLE

BACKGROUND OF THE INVENTION

1. Field of the Invention

The present disclosure relates to a structural improvement in a nursing bottle which is open at both ends and which has threads disposed on the circumferential walls at both openings for the mounting of two detachable caps, one attached with a nipple having a discharge regulating element, and the other, at the bottom of the bottle, equipped with an air-penetrating board having a number of air-inlet apertures located thereon for allowing air to flow in therethrough when the nursing bottle is held upside down and the nipple sucked, creating a difference in air pressure inside and outside the bottle, so to make the closed apertures to open, allowing air to flow in by continuous suction on the nipple. The fluid in the nursing bottle can flow out in a smooth and steady manner without generating air bubbles therein, which often cause infants to cough badly, and the used nursing bottle of the type can be easily and completely cleaned.

2. Description of the Related Art

Feeding a baby with a conventional nursing bottle without a discharge regulating element disposed between the nursing bottle and the attached nipple can often cause the infant to hack badly when the air contained therein shifts to the bottom of the upside-down nursing bottle, making fluid contained therein flow into the mouth of the baby directly without being regulated. Not being able to adjust the way sucking on the nipple, the infant using the bottle can be easily caused to cough, when the fluid flows into the infant's mouth quickly at the outset, or when the baby makes a change in his breath for swallowing the discharged fluid. Furthermore, a lot of air can be swallowed down by the infant causing indigestion when using a conventional nursing bottle. Also, nipples are often bit to distort them in shape by infants, resulting in blocking the fluid from flowing steadily and smoothly out thereof.

In the prior art of U.S. Pat. No. 2,959,314, Albert Sanchez has provided an improved nipple with a valve which consists of a plug with a stud thereon to control the discharge of the fluid contained in the bottle, and a plurality of holes are formed in the diaphragm portion around an opening for allowing air to flow into the bottle at a proper time to make the discharge in a more uniform flow. The disadvantage with this kind of design lies in the incapability of excluding air from being swallowed by the infant sucking on the nipple satisfactorily.

Furthermore, to clean a conventional nursing bottle is not quite easy, and a lot of spots thereof can not be reached in cleaning so to make the use of such bottles not secure enough from a sanitation point of view.

SUMMARY OF THE INVENTION

In view of the deficiencies and disadvantages associated with the available bottles on the market, the inventor has devoted his experience of more than 10 years in fabricating nursing bottles to providing a better nursing device, which comes to fruition at last after many tests and improvements. The primary object of the present disclosure is to provide such improved nursing bottles for babies so to make the use of the nursing bottles safer and easier.

The further object of the present disclosure is to provide an improved structure for a nursing bottle, which is opened at both ends with threads planted on their circumferential walls respectively for the attachment of a flow discharge regulating element and an air-penetrating board at the upper end and lower end respectively, so that the bottle can be assembled and disassembled readily to facilitate the cleaning of the bottle.

The further object of the present disclosure is to provide an improved nursing bottle equipped with an air penetrating board having a number of air-inlet apertures disposed thereon, which are tightly closed most of the time and opened only when the bottle is held upside down and the nipple sucked, creating a pressure difference inside the nursing bottle and the nipple, so to make the apertures open, permitting air to flow in intermittently for stabilizing the discharge of the fluid with the air therein being limited to the bottom of the fluid.

The further object of the present disclosure is to provide an improved nursing bottle having a discharge regulating element attached under the nipple by a connection so to facilitate the assembling and disassembling of the bottle and prevent easy loss of the respective component in cleaning.

The other features and advantages of the present disclosure become apparent by way of using the accompanying drawings as well as a detailed description of the preferred embodiment;

BRIEF DESCRIPTION OF DRAWINGS (1) Figures:

FIG. 3-1 is an enlarged view showing an open air-inlet aperture of the air penetrating board.

FIG. 3-2 is an enlarged view showing a closed air-inlet aperture of the penetrating board.

DETAILED DESCRIPTION OF THE PREFERRED EMBODIMENT

Figure 1:
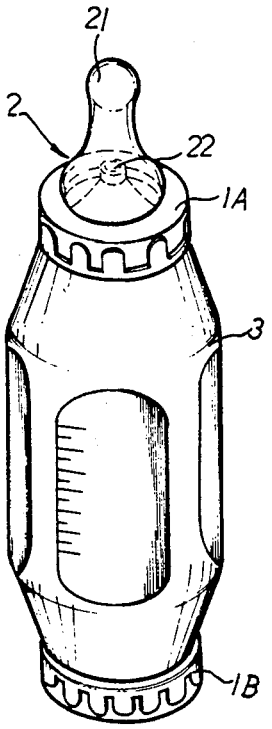
FIG. 1 is a perspective view of the assembled nursing bottle.
Figure 2:
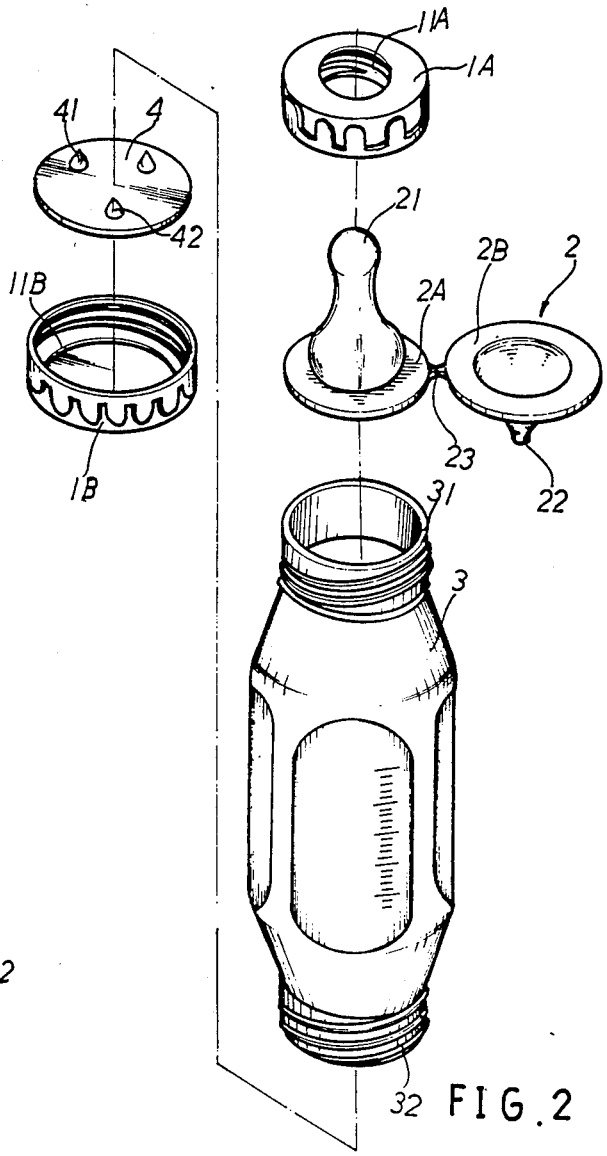
FIG. 2 is a perspective view of the exploded components of the nursing bottle.

Referring to FIGS. 1 and 2, an improved nursing bottle includes an upper cap 1A, a lower cap 1B, a nipple assemblage 2 comprising a nipple 2A in connection with a discharge regulating element, a bottle 3 and an air-penetrating board 4, wherein the upper cap 1A and lower cap 1B are general covers only with their inner walls threaded and top central portions removed to form circular openings 11A, 11B respectively.

The nipple 2A in conjunction with the funnel-shaped discharge regulating element 2B by a connector 23 as a whole, is disposed at the mouth of the bottle 3 with said regulating element 2B received under said nipple 2A as shown in FIG. 1. The nipple 2A has a sucking head 21 at the topmost end thereof, and a dripping passage 22 is placed at the uppermost end of the discharge regulating element 2B. The nursing bottle 3 is fabricated with both ends opened to form an upper bottle mouth 31 and a lower bottle opening 32, and external threads are provided around the circumferential walls thereof for allowing said upper cap 1A and lower cap 1B to removably attached thereto respectively. The circular air-penetrating board 4 is made of soft synthetic rubber, having a number of cone-shaped air-inlet inlet apertures 41 symmetrically distributed thereon, each of which is operated by a pair of check-valve elements 42 serving as a check valve, one-way openable but tightly closed in the other. When assembled, the sucking head 21 of the nipple 2A is first placed through the central circular opening 11A of the upper cap 1A, and then the funnel-shaped discharge regulating element 2B is disposed thereunder in an upside down position with the fluid dripping passage 22 located at the uppermost position and its circular lip mounted on the circumference of the upper bottle mouth 31, with the upper cap 1A securely screwed down thereto; and the air-penetrating board 4 is removably secured to the bottom thereof by the removably attached lower cap 1B in which said board 4 is disposed with the check-valve elements 42 set inside the bottle 3 when assembled as a whole.

Figure 3:
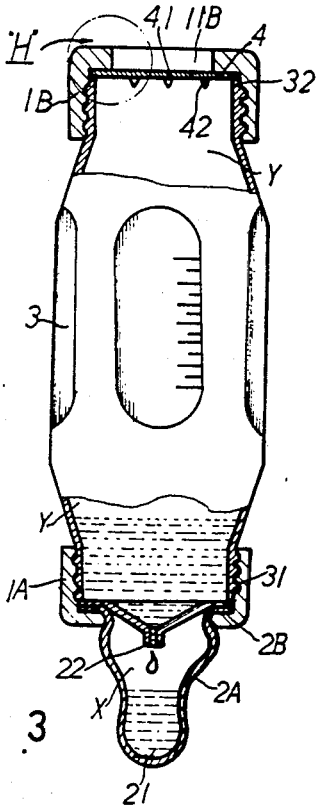
FIG. 3 is a cross sectional view of the assembled nursing bottle.
Figures 2, 3:
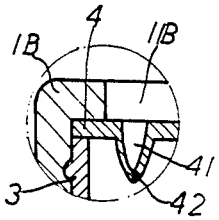
Figures 1, 3:
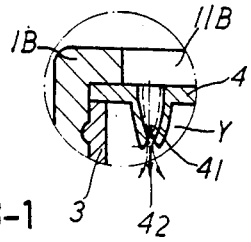

Referring to FIG. 3, there are two air volumes X and Y, formed in between said nipple 2A and said discharge regulating element 2B, and between the bottom of the bottle 3 and the bottom of the fluid respectively, as said nursing bottle 3 is held upside down. The air pressures between the two volumes X and Y are well balanced as long as the nipple 2A is freed from suction, but the pressures lose their balance at the suction of the nipple 2A, owing to a difference in pressure which makes the fluid contained in said bottle 3 flow into said nipple 2A through said dripping passage 22 of said discharge regulating element 2B, and in the meantime the air pressure of the air volume Y is changed in accordance with the variation of the air pressure in air volume X, so that the atmospheric pressure, now greater than the air pressure in the air volume Y, can force the check-valve elements 42 into an open state, so taht the air-inlet apertures 41, are opened permitting air to flow in continuously therethrough as shown in FIG. 3-1 (the air flow indicated by the arrows). The opened check valve elements 42 will resume its original shut state only when the air pressures in the air volume X and air volume Y reach a balance again (as shown in FIG. 3-2), and the fluid contained in the bottle 3 stops dripping into the nipple 2A at the same time. The fluid contained in the nipple 2A is always maintained at the same level as shown in FIG. 3. In such described manner, the fluid can be discharged smoothly and completely through the suction of the nipple 2A by the infant, and the air limited to the bottom of the bottle 3 can not be swallowed by the infant along with the fluid contained therein so as to prevent indigestion from happening, and the check valve elements 42 can only be opened in one way by suction, so the shaking of the bottle 3 in preparing milk or the like can not make a those check valve elements 42 open to leak the fluid out thereof. Besides, the detachable bottom cap 1B makes the cleaning of the bottle 3 easier and more complete.

The foregoing preferred embodiment is considered illustrative only. Numerous other modifications and changes will readily occur to those persons skilled in the pertinent art after reading this disclosure. Consequently, the disclosed invention is not limited to the exact construction and operation shown and described herein but rather is encompassed within the scope of the letter and spirit of the appended claims.

What I claim is:

1. A nursing bottle structure comprising:

a bottle having two open ends with reduced diameters and threads provided on circumferential walls thereof;

upper and lower caps being engaged with the threads on the circumferential walls of the two open ends of the bottle and each having a circular opening at a central portion thereof;

a nipple secured at one of the two open ends of the bottle in the circular opening of the upper cap;

a funnel-shaped discharge regulating element held by the upper cap under the nipple and arranged with a dripping passage facing outwardly from the open end of the bottle; and means for flexibly hinging the discharge regulating element together with the nipple as a unit; and an air-penetrating board being held opposite to the nipple at the other of the two open ends of the bottle in the circular opening of the lower cap and having a plurality of air-inlet apertures, each including a cone-shaped check valve means for permitting air to flow into the bottle when suction force on the nipple opens the check valve means;

whereby air is enabled to flow into the bottle directly through the check valve means of the air-inlet apertures so that fluid contained in the bottle can be discharged in a steady manner without being mixed with the air.

* * * * *